US009051721B2

(12) United States Patent
Paulsen et al.

(10) Patent No.: US 9,051,721 B2
(45) Date of Patent: Jun. 9, 2015

(54) DEVICE FOR CLEARING A DRAIN

(71) Applicants: Howard C. Paulsen, Utica, NY (US); Richard J. Paulsen, Utica, NY (US)

(72) Inventors: Howard C. Paulsen, Utica, NY (US); Richard J. Paulsen, Utica, NY (US)

( * ) Notice: Subject to any disclaimer, the term of this patent is extended or adjusted under 35 U.S.C. 154(b) by 314 days.

(21) Appl. No.: 13/765,069

(22) Filed: Feb. 12, 2013

(65) Prior Publication Data

US 2014/0223654 A1 Aug. 14, 2014

(51) Int. Cl.
*E03D 9/00* (2006.01)
*E03C 1/306* (2006.01)

(52) U.S. Cl.
CPC ..... *E03C 1/306* (2013.01)

(58) Field of Classification Search
USPC ..... 4/255.04, 255.05, 255.08; 134/166 C, 134/167 C
See application file for complete search history.

(56) References Cited

U.S. PATENT DOCUMENTS 576,507 A * 2/1897 McClelland ..... 4/255.06
2,274,453 A * 2/1942 Matter ..... 4/255.04
2,670,475 A 3/1954 Hord
3,595,255 A 7/1971 Mulinex
4,238,860 A 12/1980 Dixon
4,354,515 A 10/1982 Sutherland
4,847,923 A 7/1989 Huang
4,957,123 A 9/1990 McHugh
5,329,646 A * 7/1994 Bevacco et al. ..... 4/255.08
5,974,596 A 11/1999 Strzok
6,405,385 B1 6/2002 Smith
7,877,821 B1 2/2011 Prestia
2008/0276359 A1 11/2008 Morgan et al.
2009/0293214 A1 12/2009 Ackerman et al.
2010/0264046 A1 10/2010 Bates et al.

OTHER PUBLICATIONS

International Search Report for application PCT/US2014/013716. May 14, 2014. All pages relevant.

* cited by examiner

*Primary Examiner* — Lauren Crane
(74) *Attorney, Agent, or Firm* — Richard L Miller

(57) ABSTRACT

An improved drain unclogging device of the type having a drain bladder for sealing in the drain and a water source interface in fluid communication with the drain bladder and fluidly interfacing with a water source to provide high pressure water to and exit from the drain bladder to unclog the drain. The improvement includes a sliding bladder restrictor that is movable over the drain bladder and restricts a portion of the drain bladder that remains outside the drain to prevent distortion of that portion of the drain bladder that would reduce pressure of the high pressure water that is exiting the drain bladder and unclogging the drain.

19 Claims, 6 Drawing Sheets

DEVICE FOR CLEARING A DRAIN

1. BACKGROUND OF THE INVENTION

A. Field of the Invention

The embodiments of the present invention relate to a drain unclogging device, and more particularly, the embodiments of the present invention relate to a drain unclogging device for sealing in a drain, for being restricted outside the drain, and for interfacing with a water source to provide high pressure water to unclog the drain.

B. Description of the Prior Art

Numerous innovations for drain clog removers have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention in that they do not teach a drain unclogging device for sealing in a drain, for being restricted outside the drain, and for interfacing with a water source to provide high pressure water to unclog the drain.

(1) U.S. Pat. No. 2,670,475 to Hord.

U.S. Pat. No. 2,670,475—issued to Hord on Mar. 2, 1954 in U.S. class 4 and subclass 255.05—teaches a hose attachment including an inner tubular valve member having an externally threaded intermediate portion and a sleeve having an externally and internally threaded intermediate portion threaded for longitudinal adjustment on the valve member. The sleeve further has a seat engageable by the valve member and still further having externally threaded end portions. A resilient made adapter is engageable in a drain and includes a metallic bushing threaded on one portion of the sleeve. A packing nut is threaded on the other end portion of the sleeve. A resilient, substantially cup-shaped adapter includes a metallic bushing threaded on the intermediate portion of the sleeve and engageable with a surface surrounding the drain. The second-named bushing is screwable on and past the one end portion of the sleeve for threaded engagement with the intermediate portion of the sleeve.

(2) U.S. Pat. No. 4,847,923 to Huang.

U.S. Pat. No. 4,847,923—issued to Huang on Jul. 18, 1989 in U.S. class 4 and subclass 255.03—teaches a water and air whirlpool double flush toilet clog remover having a hollow cylinder, a top cover with air ports attached to the cylinder, a fixed direction filling device having a piston within the cylinder, a hollow plug pressure lever with one end attached to the piston and another end passing through the top cover and attached to a handle, and a guide flow device attached to the bottom of the cylinder. The fixed direction filling device provides one-way directional flow of water and/or air into the cylinder from the hollow plug pressure lever when the handle is raised. The guide flow device provides a whirlpool of water and/or air into the toilet to be unclogged when the handle is lowered.

(3) U.S. Pat. No. 5,329,646 to Bevacco et al.

U.S. Pat. No. 5,329,646 issued to Bevacco et al. on Jul. 19, 1994 in U.S. class 4 and subclass 255,08 teaches a drain flusher device for dislodging an obstruction in a pipe. The drain flushing device has an elastomeric cylindrical body with an open neck end and nose portion having a thickened end wall. An elongated slit with a predetermined configuration and predetermined dimensions extends through the thickened forward end wall. A connector is fixed at the body neck end and is adapted for attachment to a pressurized fluid source, such as a garden hose.

(4) U.S. Pat. No. 5,974,596 to Strzok.

U.S. Pat. No. 5,974,596—issued to Strzok on Nov. 2, 1999 in U.S. class 4 and subclass 255.11—teaches a hand-operated plunger for clearing drains and other plumbing fixtures of obstructions. The hand-operated plunger has two coaxial handles that help maintain a seal with the plumbing fixture during operation and check valves that direct hydraulic or pneumatic pressure to the obstruction through the application of hand force applied to the movable handle. In the event that one stroke of the handle does not dislodge the obstruction, a second or subsequent stroke may be applied without losing all of the pressure developed from the first stroke. In one preferred embodiment, air is used to create pneumatic pressure that is applied to the obstruction through check valves, and the pressure is increased by subsequent strokes of the movable plunger handle. In an alternate embodiment, liquid, such as water, is used to create hydraulic pressure that is applied to the obstruction through check valves, and the pressure developed is directly related to the force applied to the movable plunger handle.

(5) U.S. Pat. No. 6,405,385 to Smith.

U.S. Pat. No. 6,405,385—issued to Smith on Jun. 18, 2002 in U.S. class 4 and subclass 255.01—teaches a plunger device for unclogging a toilet drain, which includes a housing that is elongated and has a open first end and an open second end. A peripheral wall extends between the first and second ends. The first and second ends are generally circular. The first end has a smaller diameter than a diameter of the second end. The diameter of the second end is larger than a toilet drain. A pump may be used for forcing air into the housing, and is removably in communication with the first end of the housing. The second end of the housing is positioned over the toilet drain so that air is moved from the pump and into the housing causing water in the toilet to be forced into the drain and unclogging the drain.

(6) United States Patent Application Publication Number 2008/0276359 to Morgan et al.

United States Patent Application Publication Number 2008/0276359—published to Morgan et al. on Nov. 13, 2008 in U.S. class 4 and subclass 255.04—teaches a drain clog remover that includes a container adapted to hold a drain cleaning composition and a shaft defining a delivery passage fluidly communicating with the container. In certain embodiments, the shaft includes projections for mechanically engaging and removing clog-forming material from the drain pipe. In other embodiments, the shaft is slidably coupled to the container for moving between a retracted position for storage and an extended position for use.

(7) United States Patent Application Publication Number 2009/0293214 to Ackerman et al.

United States Patent Application Publication Number 2009/0293214—published to Ackerman et al. on Dec. 3, 2009 in U.S. class 15 and subclass 104.05—teaches an apparatus for removing drain clog material from a drain pipe assembly. The assembly has a container and a shaft. The container defines a reservoir adapted to receive a drain cleaning composition. The container also has an outlet. The shaft is attached to the outlet of the container and is in fluid communication with the container. The shaft also has an X-direction, a Y-direction perpendicular thereto, and a Z-direction perpendicular to both the X- and Y-directions, in addition to a plurality of barbs extending outwardly. The barbs have a force to remove of less than 20 lbs. and a peak bend force of less than 4 lbs.

(8) United States Patent Application Publication Number 2010/0264046 to Bates et al.

United States Patent Application Publication Number 2010/0264046—published to Bates et al. on Oct. 21, 2010 in U.S. class 206 and subclass 223—teaches an apparatus for removing a clog from a drain pipe, which includes a container having a product chamber, a pressurization assembly in fluid communication with the inlet, and a shaft coupled to the container. The shaft includes a proximal end and a distal end. Projections extend outwardly from the shaft. The product chamber is adapted to receive a drain cleaning composition and the product chamber has an inlet and an outlet. The pressurization assembly has a canister of pressurized fluid and an adapter coupled to the container and including a socket defining a receptacle configured to receive at least a portion of the canister. The shaft has an exterior surface sized for insertion into the drain pipe. The shaft also has a channel that provides fluid communication between the proximal end and the distal end.

(9) U.S. Pat. No. 7,877,821 to Prestia.

U.S. Pat. No. 7,877,821—issued to Prestia on Feb. 1, 2011 in U.S. class 4 and subclass 255.04—teaches a hand-held gun-shaped device having an air compressor, an air chamber, and at least one detachable drain-sealing adapter, which are used together to clear soft stoppages from single drains. Air compressor power may be supplied by a removable power cord or battery. Optional features include a detachable side handle, a toilet plunger adapter, a hollow cup adapter for shower and kitchen sink drains, a funnel-shaped adapter for bathtub and sink drains, an air compressor tire valve, a tire valve attachment, a safety-release valve, and a pressure gauge. An operator sets the PSI setting dial or display on the air compressor above a needed threshold air chamber pressure and starts the air compressor. When the air compressor stops and an air chamber release button is activated, a drain-unclogging air burst is released from the air chamber. One charge of the air chamber provides one air burst.

It is apparent that numerous innovations for drain clog removers have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a drain unclogging device for sealing in a drain, for being restricted outside the drain, and for interfacing with a water source to provide high pressure water to unclog the drain.

2. SUMMARY OF THE INVENTION

Thus, an object of the embodiments of the present invention is to provide a drain unclogging device for sealing in a drain, for being restricted outside the drain, and for interfacing with a water source to provide high pressure water to unclog the drain, which avoids the disadvantages of the prior art.

Briefly stated, another object of the embodiments of the present invention is to provide an improved drain unclogging device of the type having a drain bladder for sealing in the drain and a water source interface in fluid communication with the drain bladder and fluidly interfacing with a water source to provide high pressure water to and exit from the drain bladder to unclog the drain. The improvement includes a sliding bladder restrictor that is movable over the drain bladder and restricts a portion of the drain bladder that remains outside the drain to prevent distortion of that portion of the drain bladder that would reduce pressure of the high pressure water that is exiting the drain bladder and unclogging the drain.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

Figure 10:
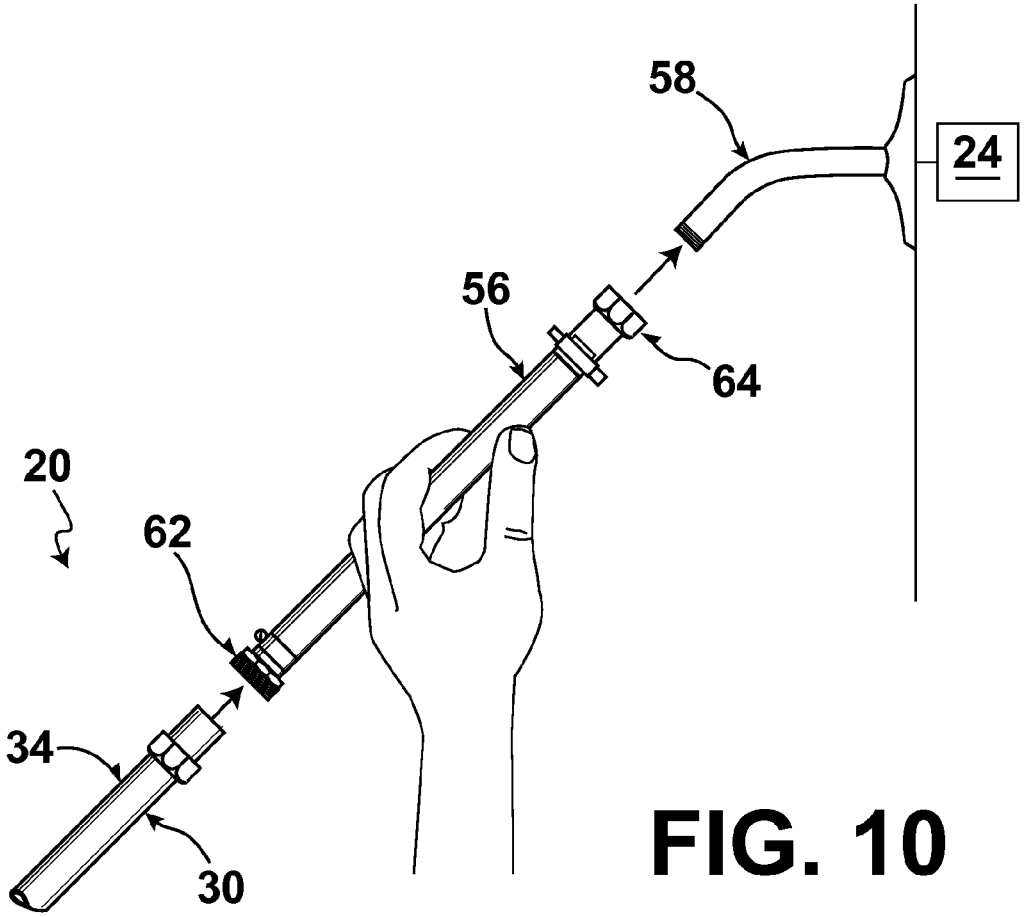
FIG. 10 is a diagrammatic side elevational view of a hose extension of the drain unclogging device of the embodiments of the present invention being screwed onto the shower and the water source interface of the drain unclogging device of the embodiments of the present invention.
Figure 11:
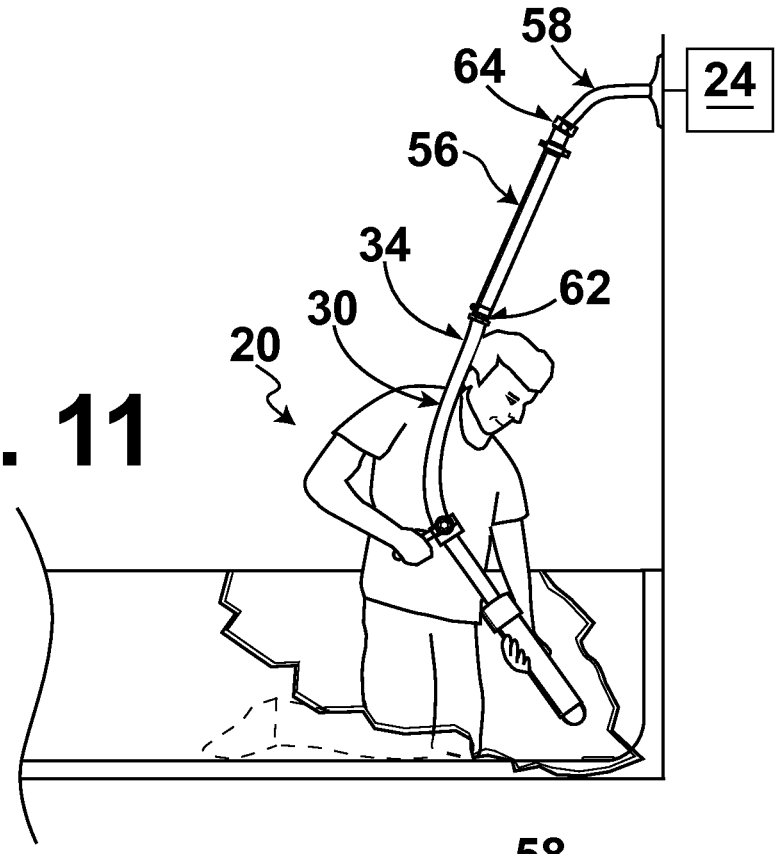
Figure 12:
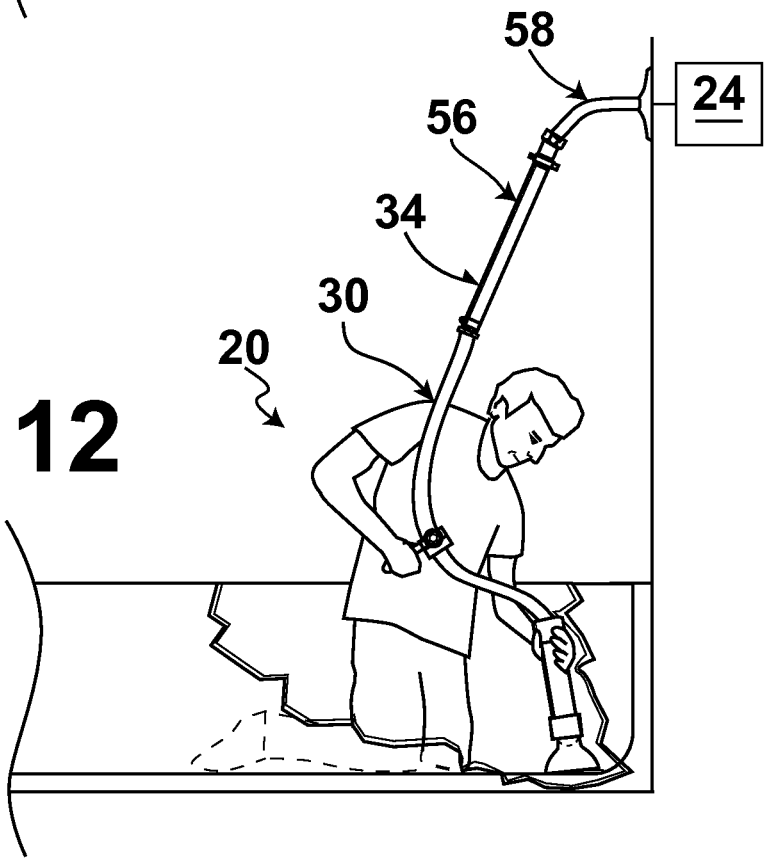

FIG. 11 is a reduced diagrammatic side elevational view of a user using the hose extension of the drain unclogging device of the embodiments of the present invention shown in FIG. 10 to clean a drain having a removable stopper; and FIG. 12 is a reduced diagrammatic side elevational view of a user using the hose extension of the drain unclogging device of the embodiments of the present invention shown in FIG. 10 to clean a drain having a non-removable stopper.

4. LIST OF REFERENCE NUMERALS UTILIZED IN THE FIGURES OF THE DRAWING

A. Introductory.

20 drain unclogging device of embodiments of present invention for sealing in drain

22, for being restricted outside drain 22, and for interfacing with water source 24 to provide high pressure water 26 to unclog drain 22

22 drain

24 water source

26 high pressure water

B. Configuration of Drain Unclogging Device 20.

28 drain bladder for sealing in drain 22

30 water source interface for fluidly interfacing with water source 24 to provide high pressure water 26 to and exit from drain bladder 28 to unclog drain 22

32 sliding bladder restrictor

34 hose body of water source interface 30 for fluidly communicating with water source 24

36 ballcock shutoff valve of hose body 34 of water source interface 30 for controlling water passing through hose body 34 of water source interface 30

37 pair of female ends of hose body 34 of water source interface 30

38 tubular portion of sliding bladder restrictor 32

40 proximal end of tubular portion 38 of sliding bladder restrictor 32

42 distal end of tubular portion 38 of sliding bladder restrictor 32

44 beveled cap of sliding bladder restrictor 32

46 axial through bore of beveled cap 44 of sliding bladder restrictor 32

48 drain plunger adapter

50 drain plunger head of drain plunger adapter 48

52 collar of drain plunger adapter 48

54 non-removable stopper of drain 22

56 extension hose for fluidly attaching to shower 58 after shower head 60 of shower 58 has been removed so as to allow shower 58 to provide water source 24

58 shower

60 shower head of shower 58

62 male end of extension hose 56

64 female end of extension hose 56

5. DETAILED DESCRIPTION OF THE PREFERRED EMBODIMENTS

A. Introductory.

Figure 1:
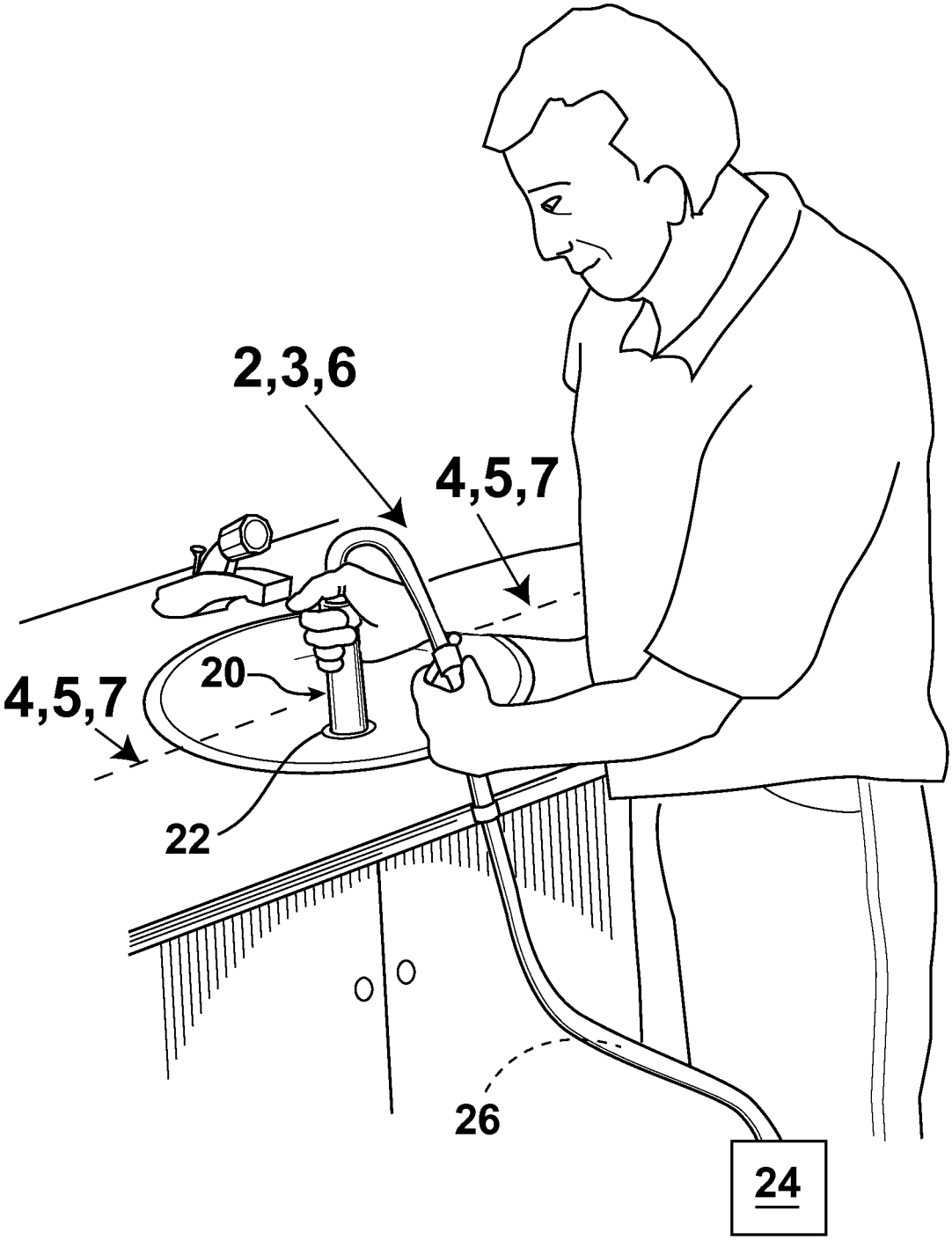
FIG. 1 is a diagrammatic perspective view of the drain unclogging device of the embodiments of the present invention sealing in a drain, being restricted outside the drain, and interfacing with a water source to provide high pressure water to unclog the drain.
Figure 2:
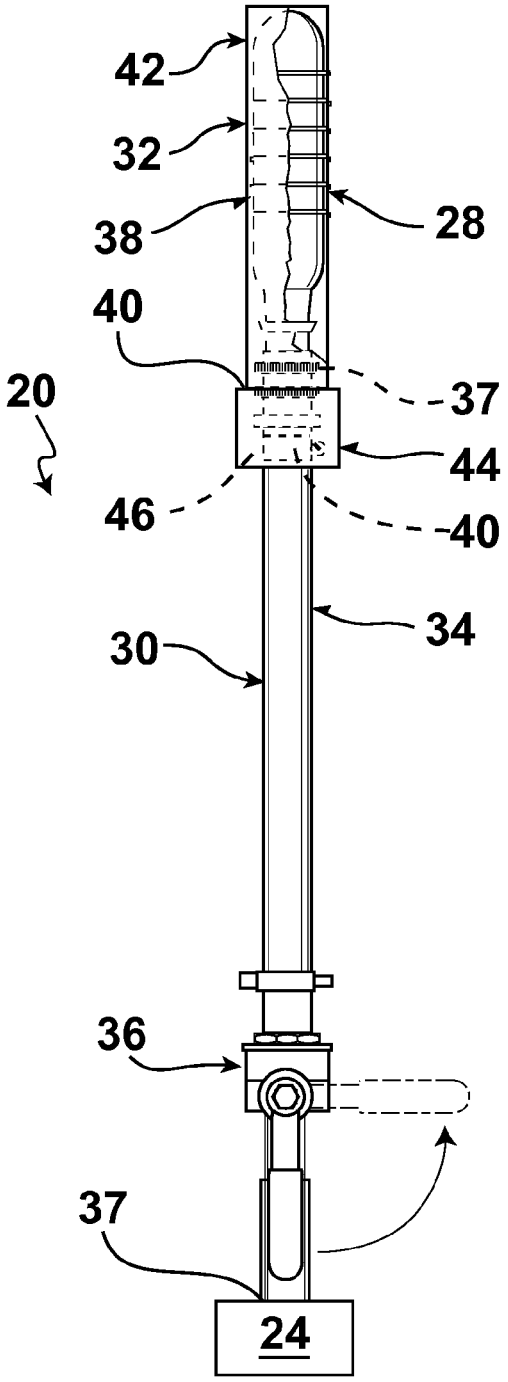
FIG. 2 is an enlarged diagrammatic side elevational view of the drain unclogging device of the embodiments of the present invention identified by ARROW 2 in FIG. 1 prior to use.
Figure 3:
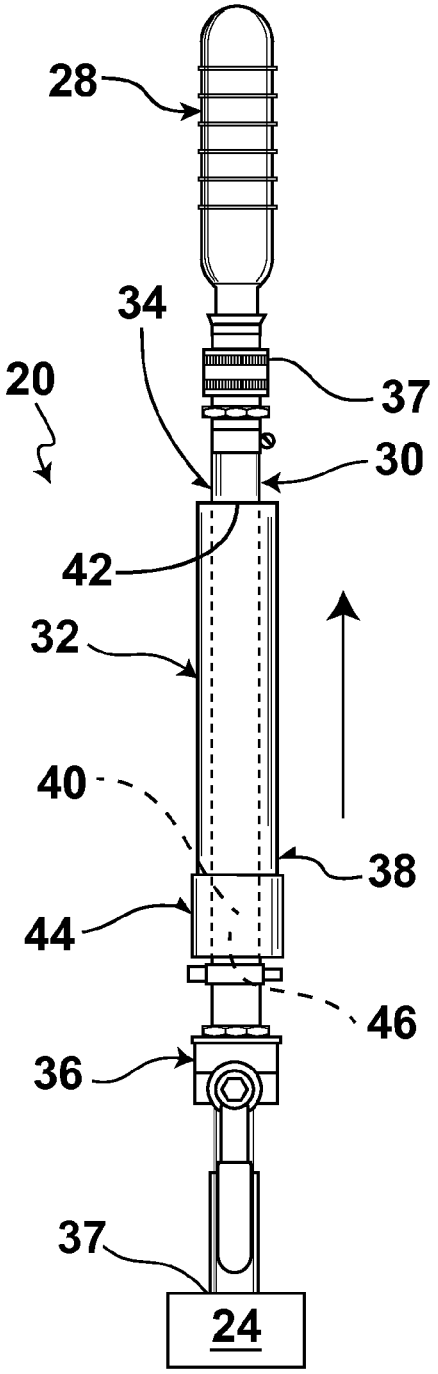
FIG. 3 is an enlarged diagrammatic side elevational view of the drain unclogging device of the embodiments of the present invention identified by ARROW 3 in FIG. 1 during use.
Figure 4:
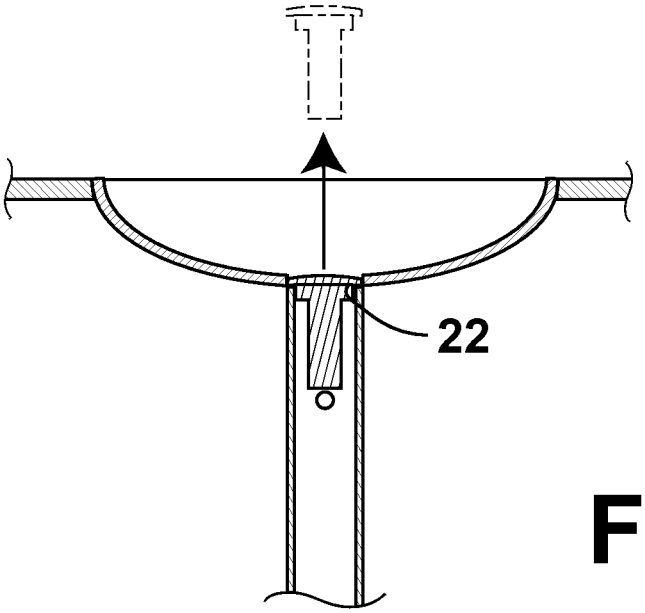
FIG. 4 is an enlarged diagrammatic cross sectional view taken along LINE 4-4 in FIG. 1 illustrating a stopper being removed from a drain.
Figure 5:
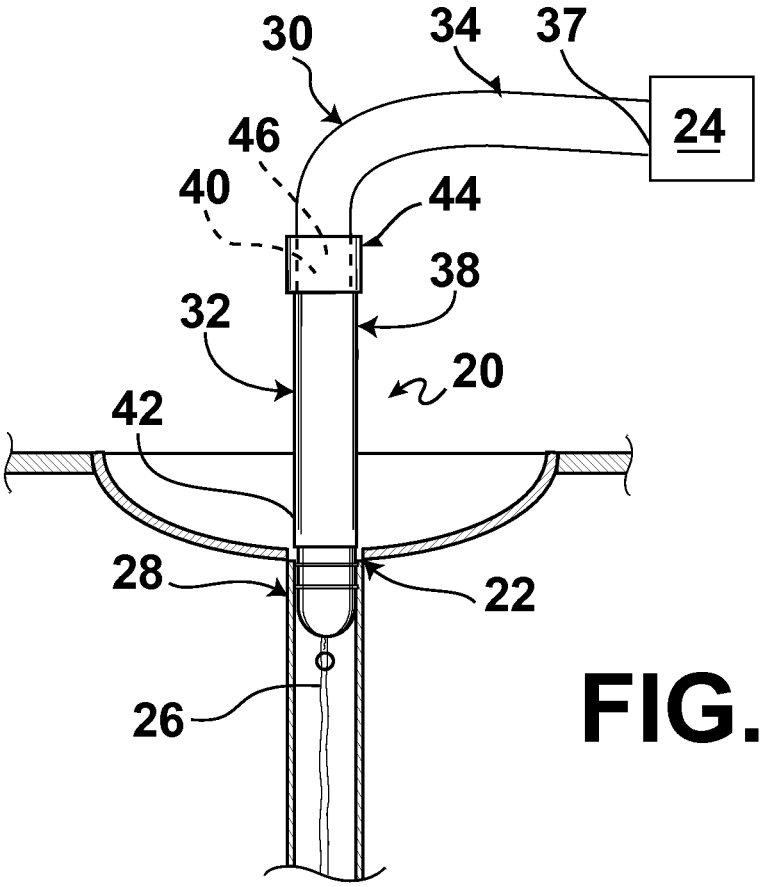
FIG. 5 is an enlarged diagrammatic cross sectional view taken along LINE 5-5 in FIG. 1.

Referring now to the figures, in which like numerals indicate like parts, and particularly to FIG. 1, which is a diagrammatic perspective view of the drain unclogging device of the embodiments of the present invention sealing in a drain, being restricted outside the drain, and interfacing with a water source to provide high pressure water to unclog the drain, the drain unclogging device of the embodiments of the present invention is shown generally at 20 for sealing in a drain 22, for being restricted outside the drain 22, and for interfacing with a water source 24 to provide high pressure water 26 to unclog the drain 22.

B. Configuration of the Drain Unclogging Device 20.

The configuration of the drain unclogging device 20 can best be seen in FIGS. 2-5, which are, respectively, an enlarged diagrammatic side elevational view of the drain unclogging device of the embodiments of the present invention identified by ARROW 2 in FIG. 1 prior to use, an enlarged diagrammatic side elevational view of the drain unclogging device of the embodiments of the present invention identified by ARROW 3 in FIG. 1 during use, an enlarged diagrammatic cross sectional view taken along LINE 4-4 in FIG. 1 illustrating a stopper being removed from a drain, and an enlarged diagrammatic cross sectional view taken along LINE 5-5 in FIG. 1, and as such, will be discussed with reference thereto.

The drain unclogging device 20 comprises a drain bladder 28 and a water source interface 30. The drain bladder 28 is for sealing in the drain 22. The water source interface 30 is in fluid communication with the drain bladder 28 and is for fluidly interfacing with the water source 24 to provide the high pressure water 26 to and exit from the drain bladder 28 to unclog the drain 22.

The drain bladder 28 is, preferably, taught by U.S. Pat. No. 5,329,646 to Bevacco et al., but is not limited to that, and is included herein by reference thereto, as supported by its description in the Background of the invention section of the instant application.

The drain unclogging device 20 further comprises a sliding bladder restrictor 32.

The sliding bladder restrictor 32 is movable over the drain bladder 28 and restrains a portion of the drain bladder 28 that remains outside the drain 22 to prevent distortion of that portion of the drain bladder 28 that would reduce pressure of the high pressure water 26 that is exiting the drain bladder 28 and unclogging the drain 22.

The water source interface 30 comprises a hose body 34.

The hose body 34 of the water source interface 30 fluidly communicates with the drain bladder 28 and is for fluidly communicating with the water source 24.

The hose body 34 of the water source interface 30 comprises a ballcock shutoff valve 36.

The ballcock shutoff valve 36 of the hose body 34 of the water source interface 30 is operatively connected within the hose body 34 of the water source interface 30 for controlling the high pressure water 26 passing through the hose body 34 of the water source interface 30.

The hose body 34 of the water source interface 30 has a pair of female ends 37.

The pair of female ends 37 of the hose body 34 of the water source interface 30 fluidly communicate with the drain bladder 28 and with the water source 24, respectively.

The sliding bladder restrictor 32 comprises a tubular portion 38.

The tubular portion 38 of the sliding bladder restrictor 32 has a proximal end 40 and a distal end 42.

The sliding bladder restrictor 32 further comprises a beveled cap 44.

The beveled cap 44 of the sliding bladder restrictor 32 fixedly caps off the proximal end 40 of the tubular portion 38 of the sliding bladder restrictor 32 and provides a comfortable receiver for a hand of a user pressing the sliding bladder restrictor 32 down onto the drain 22 to prevent the portion of the drain bladder 28 that remains outside the drain 22 from distorting that would reduce pressure of the high pressure water 26 that is exiting the drain bladder 28 and unclogging the drain 22.

The beveled cap 44 of the sliding bladder restrictor 32 has an axial through bore 46.

The axial through bore 46 of the beveled cap 44 of the sliding bladder restrictor 32 provides a passage for the hose body 34 of the water source interface 30 to pass therethrough.

The drain unclogging device 20 further comprises a drain plunger adapter 48.

Figure 6:
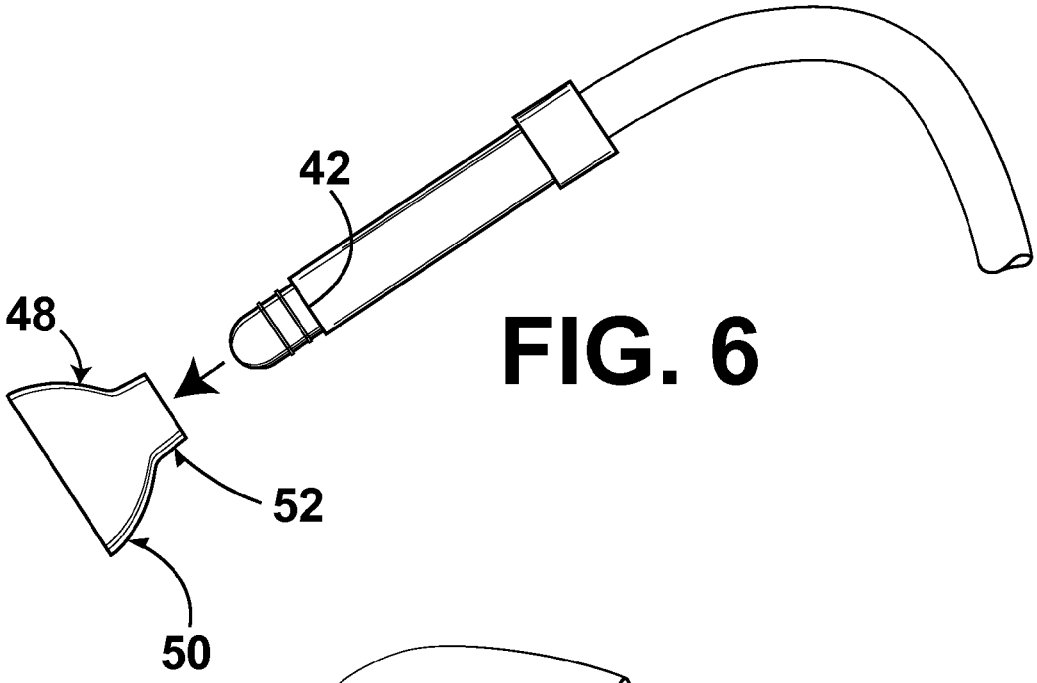
FIG. 6 is an enlarged and exploded diagrammatic side elevational view of the drain unclogging device of the embodiments of the present invention identified by ARROW 6 in FIG. 1 for use with a drain having a non-removable stopper.
Figure 7:
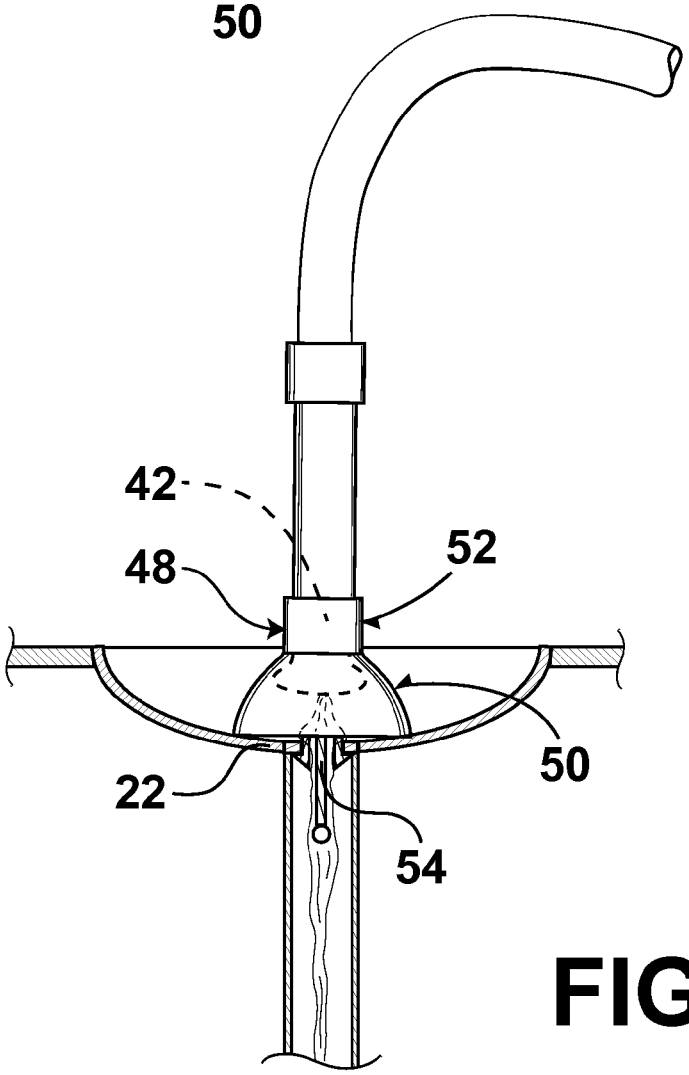
FIG. 7 is an enlarged diagrammatic cross sectional view taken along LINE 7-7 in FIG. 1.

The configuration of the drain plunger adapter 48 can best be seen in FIGS. 6 and 7, which are, respectively, an enlarged and exploded diagrammatic side elevational view of the drain unclogging device of the embodiments of the present invention identified by ARROW 6 in FIG. 1 for use with a drain having a non-removable stopper, and an enlarged diagrammatic cross sectional view taken along LINE 7-7 in FIG. 1, and as such, will be discussed with reference thereto.

The drain plunger adapter 48 comprises a drain plunger head 50 and a collar 52.

The collar 52 of the drain plunger adapter 48 axially receives the drain plunger head 50 of the drain plunger adapter 48 and removably receives the distal end 42 of the tubular portion 38 of the sliding bladder restrictor 32 when used with the drain 22 having a non-removable stopper 54.

The drain unclogging device 20 further comprises an extension hose 56.

Figure 8:
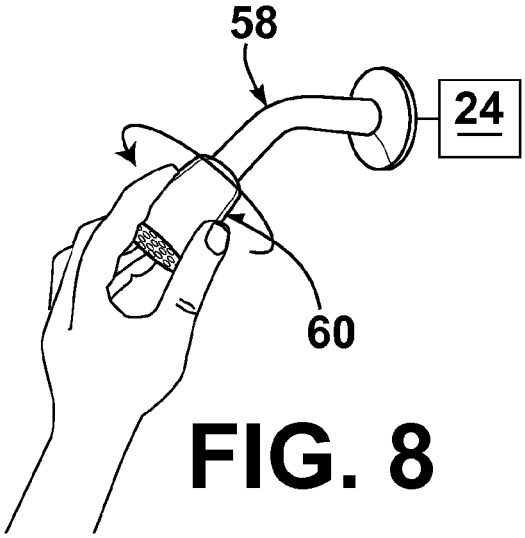
FIG. 8 is a diagrammatic perspective view of a shower head in the process of being unscrewed.
Figure 9:
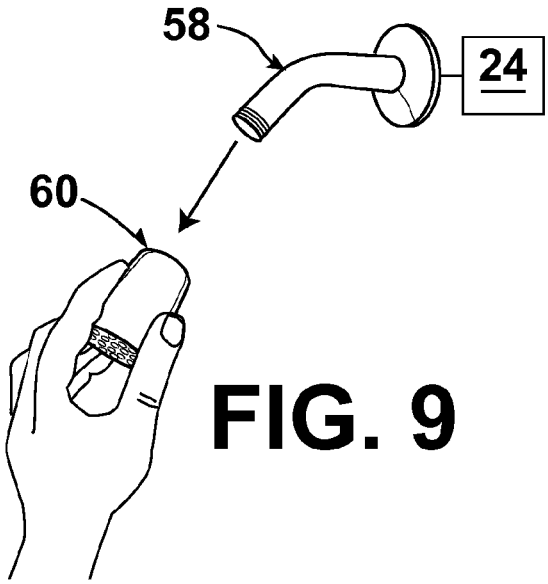
FIG. 9 is an exploded diagrammatic perspective view of a shower head shown in FIG. 8 unscrewed.

The configuration of the extension hose 56 can best be seen in FIGS. 8-12, which are, respectively, a diagrammatic perspective view of a shower head in the process of being unscrewed, an exploded diagrammatic perspective view of a shower head shown in FIG. 8 unscrewed, a diagrammatic side elevational view of a hose extension of the drain unclogging device of the embodiments of the present invention being screwed onto the shower and the water source interface of the drain unclogging device of the embodiments of the present invention, a reduced diagrammatic side elevational view of a user using the hose extension of the drain unclogging device of the embodiments of the present invention shown in FIG. 10 to clean a drain having a removable stopper, and a reduced diagrammatic side elevational view of a user using the hose extension of the drain unclogging device of the embodiments of the present invention shown in FIG. 10 to clean a drain having a non-removable stopper, and as such, will be discussed with reference thereto.

The extension hose 56 is for fluidly attaching to a shower 58 after a shower head 60 of the shower 58 has been removed so as to allow the shower 58 to provide the water source 24.

The extension hose 56 fluidly attaches to the hose body 34 of the water source interface 30 to supply the water source 24 from the shower 58 to the hose body 34 of the water source interface 30.

The extension hose 56 has a male end 62 and a female end 64.

The male end 62 of the extension hose 56 fluidly communicates with the hose body 34 of the water source interface 30.

The female end 64 of the extension hose 56 fluidly communicates with the shower 58.

C. Impressions.

It will be understood that each of the elements described above or two or more together may also find a useful application in other types of constructions differing from the types described above.

While the embodiments of the present invention have been illustrated and described as embodied in a drain unclogging device for sealing partially in a drain, for being compressed partially outside the drain, and for interfacing with a water source to provide high pressure water to unclog the drain, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An improved drain unclogging device of the type having a drain bladder for sealing in the drain and a water source interface in fluid communication with the drain bladder and fluidly interfacing with a water source to provide high pressure water to and exit from the drain bladder to unclog the drain, wherein said improvement comprises:

a sliding bladder restrictor that is movable over the drain bladder and restricts a portion of the drain bladder that remains outside the drain to prevent distortion of that portion of the drain bladder that would reduce pressure of the high pressure water that is exiting the drain bladder and unclogging the drain.

2. The improved drain unclogging device of claim 1, wherein said improvement further comprises a ballcock shutoff valve.

3. The improved drain unclogging device of claim 2, wherein said improvement further comprises said ballcock shutoff valve being operatively connected within the water source interface for controlling water passing through the water source interface.

4. The improved drain unclogging device of claim 1, wherein said improvement further comprises said sliding bladder restrictor comprising a tubular portion.

5. The improved drain unclogging device of claim 4, wherein said improvement further comprises said sliding bladder restrictor comprising a beveled cap.

6. The improved drain unclogging device of claim 5, wherein said improvement further comprises said tubular portion of the sliding bladder restrictor having a proximal end; and wherein said improvement further comprises said beveled cap of said sliding bladder restrictor fixedly capping off said proximal end of said tubular portion of said sliding bladder restrictor and provides a comfortable receiver for a hand of a user pressing said sliding bladder restrictor down onto the drain to prevent the portion of the drain bladder that remains outside the drain from distorting that would reduce pressure of the high pressure water that is exiting the drain bladder and unclogging the drain.

7. The improved drain unclogging device of claim 5, wherein said improvement further comprises said beveled cap of said sliding bladder restrictor having an axial through bore.

8. The improved drain unclogging device of claim 7, wherein said improvement further comprises said axial through bore of said beveled cap of said sliding bladder restrictor providing a passage for the water source interface to pass therethrough.

9. The improved drain unclogging device of claim 1, wherein said improvement further comprises a drain plunger adapter.

10. The improved drain unclogging device of claim 9, wherein said improvement further comprises said drain plunger adapter comprising a drain plunger head.

11. The improved drain unclogging device of claim 10, wherein said improvement further comprises said drain plunger adapter comprising a collar.

12. The improved drain unclogging device of claim 11, wherein said improvement further comprises said tubular portion of said sliding bladder restrictor having a distal end; and wherein said improvement further comprises said drain plunger adapter comprising said collar of said drain plunger adapter axially receiving said drain plunger head of said drain plunger adapter and removably receiving said distal end of said tubular portion of said sliding bladder restrictor when used with the drain having a non-removable stopper.

13. The improved drain unclogging device of claim 1, wherein said improvement further comprises said water source interface having a pair of female ends.

14. The improved drain unclogging device of claim 13, wherein said improvement further comprises said pair of female ends of said water source interface fluidly communicating with said drain bladder and with the water source, respectively.

15. The improved drain unclogging device of claim 1, wherein said improvement further comprises an extension hose.

16. The improved drain unclogging device of claim 15, wherein said improvement further comprises said extension hose being for fluidly attaching to a shower after a shower head of the shower has been removed so as to allow the shower to provide the water source.

17. The improved drain unclogging device of claim 15, wherein said improvement further comprises said extension hose fluidly attaching to the water source interface to supply the water source from the shower to the water source interface.

18. The improved drain unclogging device of claim 15, wherein said improvement further comprises said extension hose having a male end; and wherein said improvement further comprises said male end of said extension hose fluidly communicating with the water source interface.

19. The improved drain unclogging device of claim 15, wherein said improvement further comprises said extension hose having a female end; and wherein said improvement further comprises said female end of said extension hose fluidly communicating with the shower.

* * * * *